US006534915B2

(12) United States Patent
Amemiya

(10) Patent No.: US 6,534,915 B2
(45) Date of Patent: Mar. 18, 2003

(54) PLASMA DISPLAY PANEL

(75) Inventor: Kimio Amemiya, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 34 days.

(21) Appl. No.: 09/773,552

(22) Filed: Feb. 2, 2001

(65) Prior Publication Data

US 2001/0011870 A1 Aug. 9, 2001

(30) Foreign Application Priority Data

Feb. 4, 2000 (JP) ..... 2000-028175

(51) Int. Cl.[7] ..... H01J 17/49
(52) U.S. Cl. ..... 313/586; 313/582
(58) Field of Search ..... 313/586, 582, 313/584, 491, 631

(56) References Cited

FOREIGN PATENT DOCUMENTS

JP 2000-251745 * 9/2000

* cited by examiner

*Primary Examiner*—Sophia S. Chen
(74) *Attorney, Agent, or Firm*—Arent Fox Kintner Plotkin & Kahn, PLLC

(57) ABSTRACT

In a plasma display panel, a floating electrode (F1) is provided each portion on at least one of the front glass substrate (10) and the back glass substrate (13) facing the vertical wall (15*a*) of the partition wall (15) defining partition between the discharge cells (C) adjacent to each other in the row direction, and formed with the same materials as the transparent electrode (Xa, Ya) or the bus electrode (Xb, Yb).

11 Claims, 10 Drawing Sheets

V 1 − V 1

V 2 − V 2

W1—W1

W2—W2

W3 — W3

V 3 — V 3

W 4 — W 4

W5 −W5

PLASMA DISPLAY PANEL

BACKGROUND OF THE INVENTION

1. Field of the Invention

The invention relates to a panel structure of a plasma display panel.

2. Description of the Related Art

Recent years, a surface discharge scheme AC type plasma display panel as an oversized and slim display for color screen has been received attention, which is becoming widely available.

FIG. 10 is a schematic front view of a conventional surface discharge scheme AC type plasma display panel. FIG. 11 is a sectional view taken along the V3—V3 line of FIG. 10. FIG. 12 is a sectional view taken along the W4—W4 line of FIG. 10. FIG. 13 is a sectional view taken along the W5—W5 line of FIG. 10.

In FIG. 10 to FIG. 13, on the backside of a front glass substrate 1 to serve as a display screen of the plasma display panel, there is sequentially provided with a plurality of row electrode pairs (X', Y'); a dielectric layer 2 overlaying the row electrode pairs (X', Y'); and a protective layer 3 made of MgO which overlays a backside of the dielectric layer 2.

The row electrodes X' and Y' respectively consist of wider transparent electrodes Xa' and Ya' each formed of a transparent conductive film made of ITO (Indium Tin Oxide) or the like, and narrower bus electrodes Xb' and Yb' each formed of a metal film, complementary to conductivity of the transparent electrode.

The row electrodes X' and Y' are arranged opposing each other with a discharge gap g' interposed between them, and alternate in the column direction. Each row electrode pair (X', Y') forms a display line (row) L for matrix display.

A back glass substrate 4 faces the front glass substrate 1 with a discharge space S', filled with a discharge gas, in between. The back glass substrate 4 is provided with a plurality of column electrodes D' arranged to extend in a direction perpendicular to the row electrode pairs X' and Y'; band-shaped partition walls 5 each extending between the adjacent column electrodes D' in parallel; and a phosphor layer 6 consisting of a red phosphor layer 6(R), green phosphor layer 6(G) and blue phosphor layer 6(B) and overlaying side faces of the partition walls 5 and the column electrodes D'.

In each display line L, the column electrodes D' and the row electrode pair (X', Y') cross each other and the partition walls 5 divide the discharge space S', to form a unit light emitting area, and thus a discharge cells C' is defined therein.

In the plasma display panel, as illustrated in FIGS. 11 and 12, on the backside of the dielectric layer 2 and at a portion opposing to the bus electrodes Xb' and Yb' oriented back to back and extending in parallel, an additional dielectric layer 2A is formed to extend along the bus electrodes Xb' and Yb' in parallel.

The additional dielectric layer 2A is formed to protrude from the backside of the dielectric layer 2 into the discharge space S'. The additional dielectric layer 2A has the function of limiting the spread of a surface discharge d caused between the opposite transparent electrodes Xa' and Ya' in the discharge space S' from going toward the bus electrodes Xb' and Yb' so as to prevent occurrence of a false discharge between the discharge cells C' adjacent to each other in the column direction.

In the above surface discharge scheme AC type plasma display panel, an image is displayed as follows:

First, through addressing operation, discharge (opposite discharge) is caused selectively between the row electrode pairs (X', Y') and the column electrodes D' in the respective discharge cells C', to scatter lighted cells (the discharge cell in which wall charge is formed on the dielectric layer 2) and nonlighted cells (the discharge cell in which wall charge is not formed on the dielectric layer 2), over the panel in accordance with the image to be displayed.

After the address operation, in all the display lines L, the discharge sustain pulse is applied alternately to the row electrode pairs (X', Y') in unison. In each lighted cell, for every application of the discharge sustaining pulse, surface discharge is produced in each space between a pair of additional dielectric layers 2A adjacent to each other sandwiching the lighted cell. The above surface discharge generates ultraviolet radiation, and thus the corresponding red (R), green (G) and/or blue (B) phosphor layers 6 in the discharge space S' are excited to emit light, resulting in forming the display image.

As explained above, in the conventional plasma display panel (PDP), the additional dielectric layer 2A formed in the portion facing the bus electrodes Xb', Yb' to extend in the row direction, limits the spreading of the discharge in the column direction in order to prevent occurrence of interference between discharges in the adjacent discharge cells C' in the column direction.

However, as shown in FIG. 13, the conventional PDP has a clearance r' which is formed between the partition wall 5 and the dielectric layer 2 and between the adjacent discharge cells C' in the row direction in order to feed and exhaust a discharge gas into and from the discharge cells C'. For this reason, as illustrated in FIG. 10, the surface discharge d in one discharge cell may spread via the clearance r' into an adjacent discharge cell C' in the row direction, to possibly cause interfering discharges.

Although the spread of the discharge in the column direction is passably limited by the additional dielectric layer 2A as explained above, if the surface discharge d develops beyond the additional dielectric layer 2A, it is impossible to completely prevent the interference between the discharges in the adjacent discharge cells C' in the column direction.

The possibility of such interference between the discharges in the row direction and the column direction increases, as a pitch between the discharge cells decreases in relation to the high definition of an image. In the event of interfering discharges, lighted and unlighted discharge cells may be reversed producing an instable and inaccurate image.

SUMMARY OF THE INVENTION

The present invention has been made to solve the above problems associated with the conventional plasma display panel.

It is therefore an object of the present invention to provide a plasma display panel which is capable of effectively preventing interference between discharge in adjoining discharge cells to display a stable image.

To attain the above object, a plasma display panel according to a first invention includes a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction on a back substrate facing the front substrate via a discharge space, and unit light emitting areas formed to be partitioned by a partition wall having at least vertical walls extending in the column direction in a discharge space corresponding to each intersection of the column electrode and the row electrode pair. Such plasma display panel features in that a floating electrode is provided on each portion of at least one of the front substrate and the back substrate facing the vertical wall of the partition wall partitioning the adjacent unit light emitting areas from each other in the row direction.

In the plasma display panel according to the first invention, for forming an image, when a surface discharge is caused between the transparent electrodes of the row electrode pair opposing each other in each unit light emitting area, and then the surface discharge caused around the gap between a pair of the transparent electrodes is moving to another pair of the transparent electrode in an adjacent unit light emitting area in the row direction, the surface discharge is attracted by the floating electrode provided to face the vertical wall of the partition wall partitioning the adjacent unit light emitting areas from each other in the row direction. This does not allow the surface discharge to reach another transparent electrode in an adjacent unit light emitting area.

According to the first invention, therefore, the spread of the surface discharge into an adjacent unit light emitting area in the row direction is limited and occurrence of interference between discharges in the adjacent unit light emitting areas is prevented, resulting in displaying stable images.

To attain the aforementioned object, a plasma display panel according to a second invention features, in addition to the configuration of the first invention, in that the floating electrode is formed of a transparent conductive film or a metal film.

According to the plasma display panel of the second invention, by reason of forming the floating electrode of a transparent conductive film or a metal film, when the surface discharge is caused between the adjacent light emitting areas in the row direction of the plasma display panel, in forming an image, then is scattering to an adjacent unit light emitting area, the floating electrode provided between the two unit light emitting electrodes attracts the surface discharge. Therefore, the surface discharge cannot reach the inside of an adjacent unit light emitting area, and interference of discharges is prevented between the adjacent unit light emitting areas in the row direction.

To attain the aforementioned object, a plasma display panel according to a third invention features, in addition to the configuration of the first invention, in that each of the transparent electrodes of the row electrode pair opposing each other via a predetermined gap is formed in an independent island-like form in each unit light emitting area, and the floating electrode is placed in a position between distal ends of the transparent electrodes in the two unit light emitting areas adjacent to each other in the row direction or a position facing the position between the distal ends of the transparent electrodes in the two adjacent unit light emitting areas.

According to the plasma display panel of the third invention, in the plasma display panel in which the transparent electrodes of the row electrode pair opposing each other with a predetermined gap in between are formed in an independent island-like form for each unit light emitting area, the floating electrode is placed in a position between the distal ends of the respective transparent electrodes in the two unit light emitting areas adjacent to each other in the row direction. As a result, it is possible to effectively prevent discharge from interfering with another unit light emitting area in the distal portions of the transparent electrodes in which the surface discharge is caused most frequently.

To attain the aforementioned object, a plasma display panel according to a fourth invention features, in addition to the configuration of the third invention, in that the floating electrode extends from a position opposing a distal portion of one of a pair of the transparent electrodes to a position opposing a distal portion of the other transparent electrode.

According to the plasma display panel of the fourth invention, between the two unit light emitting areas adjacent to each other in the row direction, the floating electrode is interposed between the opposing distal portions of respective one of the adjacent pair of transparent electrodes, between the opposing distal portions of the other, and between the opposing gaps formed between each pair of transparent electrodes. This configuration can further advantageously block the scattering of the surface discharge between the two adjacent unit light emitting areas, resulting in preventing occurrence interference between discharges.

To attain the aforementioned object, a plasma display panel according to a fifth invention features, in addition to the configuration of the first invention, in that the floating electrode has a widthwise extended portion integrated with a main body extending along the vertical wall of the partition wall facing the main body, and extending in a direction perpendicular to the vertical wall.

According to the plasma display panel of the fifth invention, a widthwise extended portion extending in a direction perpendicular to the vertical wall of the partition walls, namely a direction at right angles to the main body of the floating electrode, prevents the main body formed in the floating electrode to have a smaller width because it faces the vertical wall of the partition wall, from separating from the front substrate or the back substrate.

These and other objects and features of the present invention will become more apparent from the following detailed description with reference to the accompanying drawings.

DETAILED DESCRIPTION OF THE PREFERRED EMBODIMENT

Most preferred embodiment according to the present invention will be described hereinafter in detail with reference to the accompanying drawings.

Figure 1:
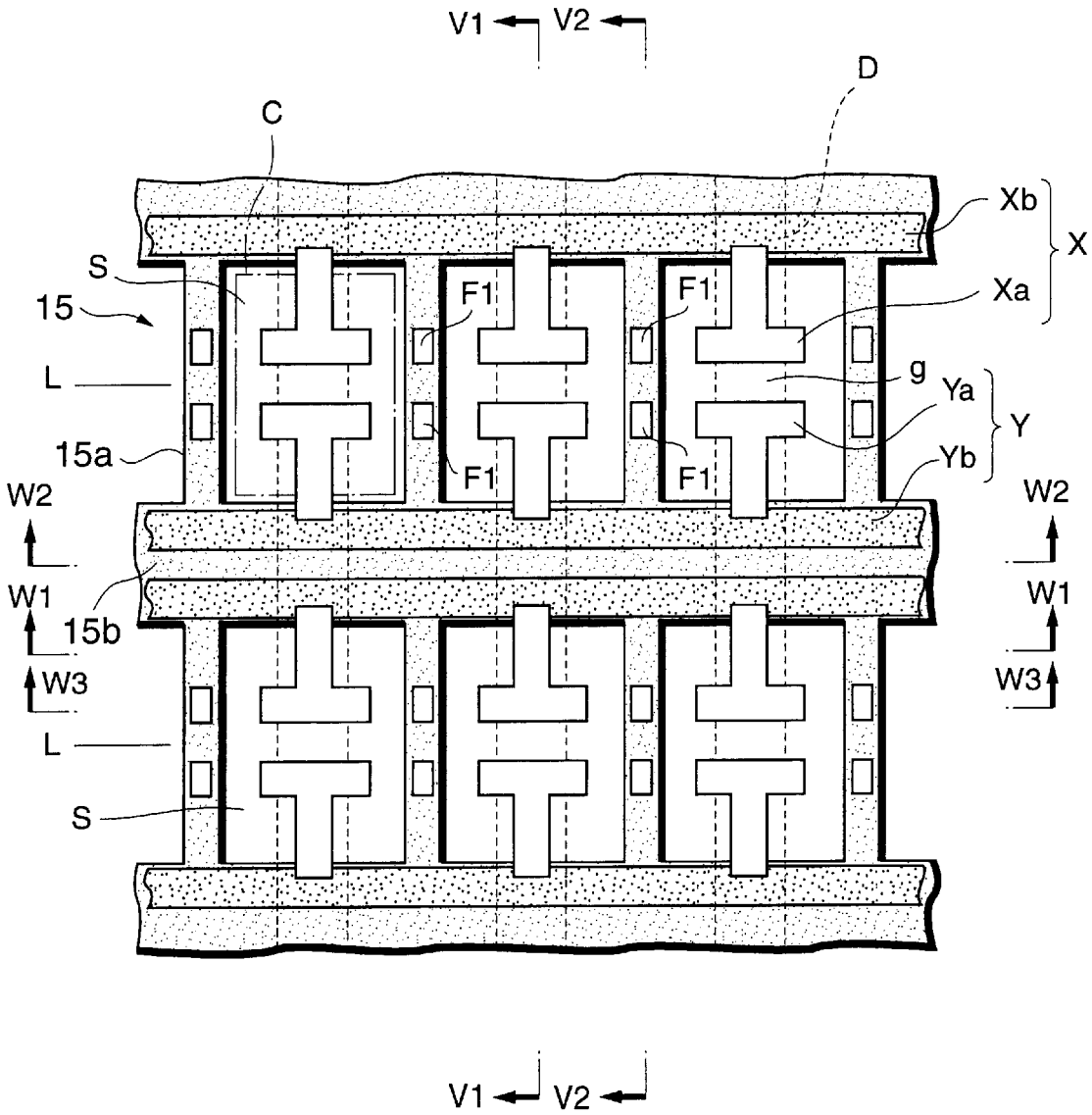
FIG. 1 is a schematically front view illustrating a first example according to a preferred embodiment of the present invention.
Figure 2:
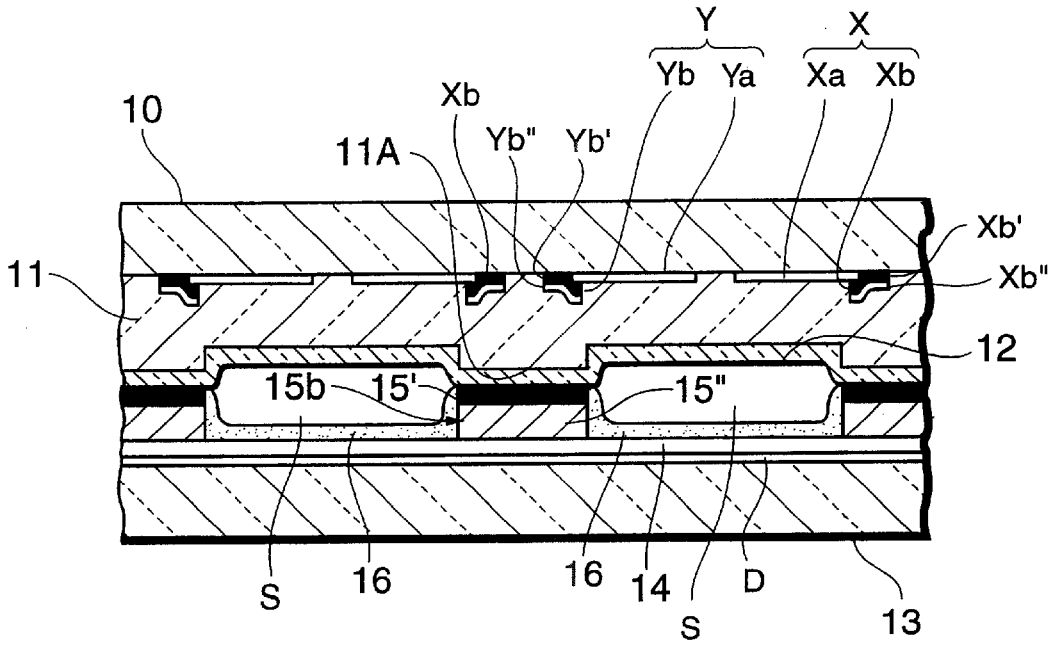
FIG. 2 is a sectional view taken along the V1—V1 line of FIG. 1.
Figure 3:
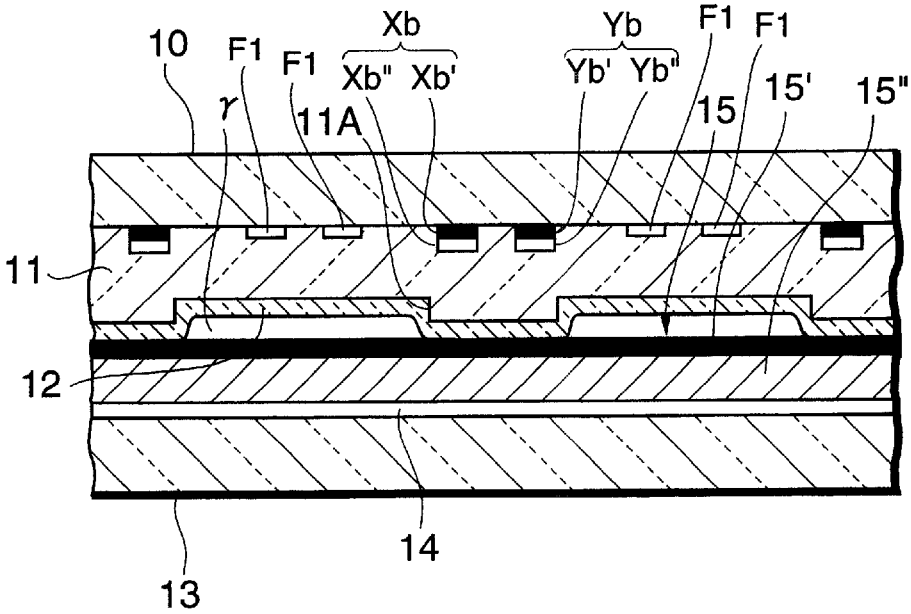
FIG. 3 is a sectional view taken along the V2—V2 line of FIG. 1.
Figure 4:
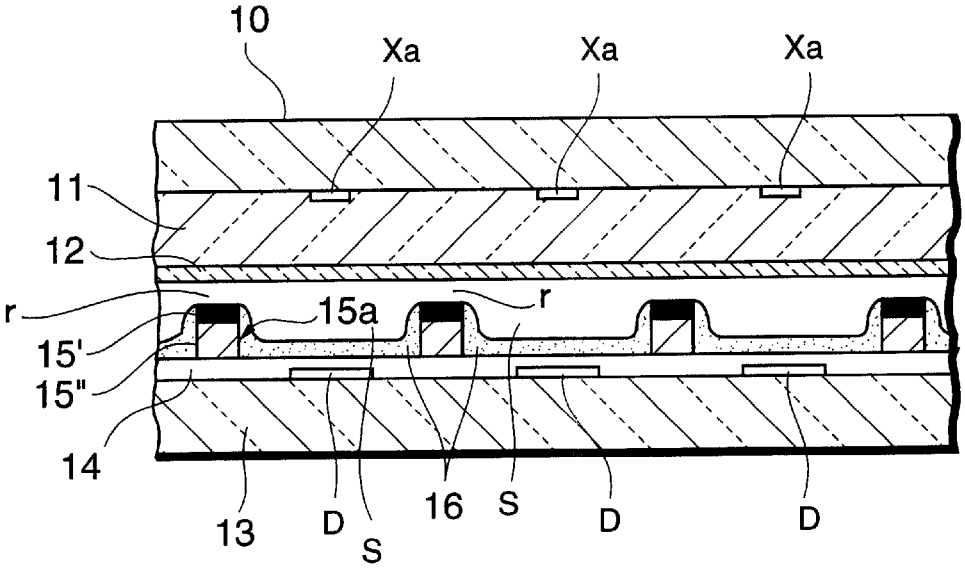
FIG. 4 is a sectional view taken along the W1—W1 line of FIG. 1.
Figure 5:
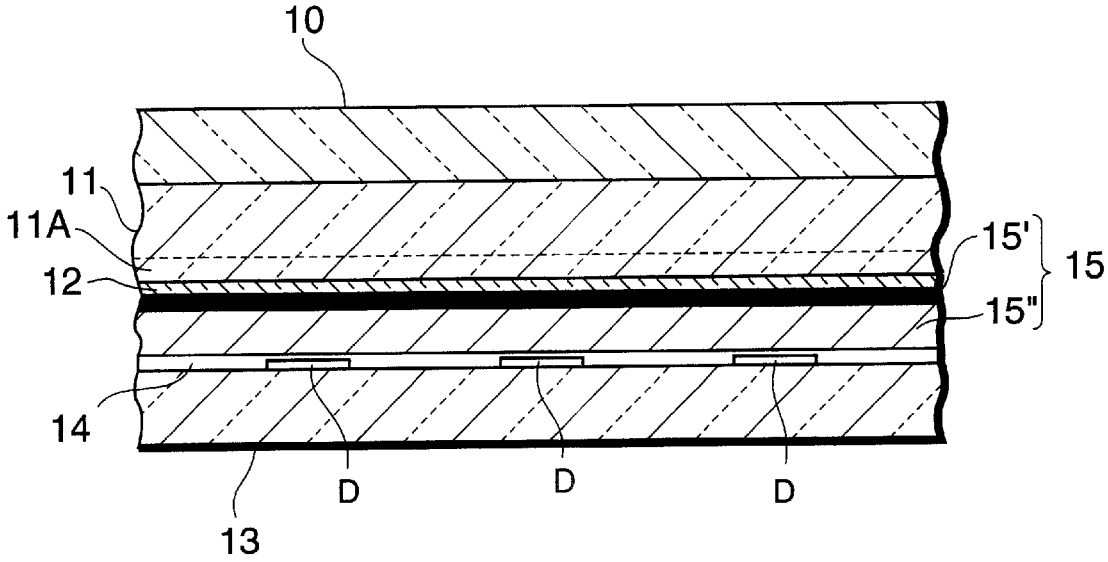
FIG. 5 is a sectional view taken along the W2—W2 line of FIG. 1.
Figure 6:
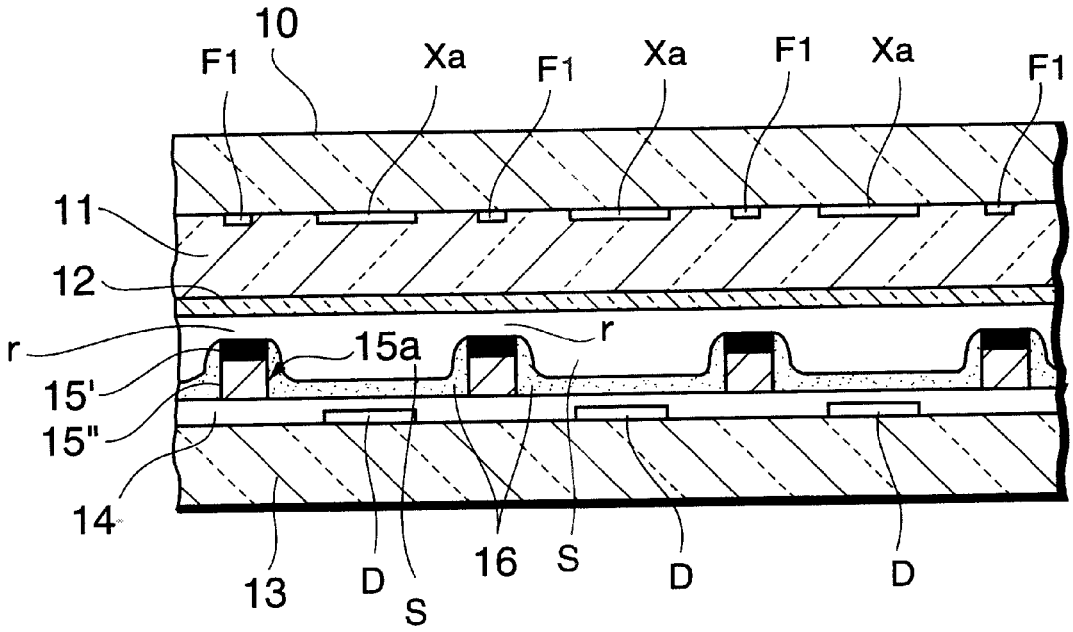
FIG. 6 is a sectional view taken along the W3—W3 line of FIG. 1.

FIGS. 1 to 6 illustrate an example of the embodiment of a plasma display panel (referred as "PDP" hereinafter) according to the present invention. FIG. 1 is a front view schematically presenting the relationship between a row electrode pair and a partition wall of the PDP. FIG. 2 is a sectional view taken along the V1—V1 line of FIG. 1. FIG. 3 is a sectional view taken along the V2—V2 line of FIG. 1. FIG. 4 is a sectional view taken along the W1—W1 line of FIG. 1. FIG. 5 is a sectional view taken along the W2—W2 line of FIG. 1. FIG. 6 is a sectional view taken along the W3—W3 line of FIG. 1.

In FIG. 1 to FIG. 6, on a backside of a front glass substrate 10 serving as the display surface, a plurality of row electrode pairs (X, Y) are arranged in parallel to extend in the row direction (in the traverse direction in FIG. 1) of the front glass substrate 10.

The row electrode X is composed of transparent electrodes Xa formed in a T-like shape of a transparent conductive film made of ITO or the like, and a bus electrode Xb which is formed of a metal film extending in the row direction of the front glass substrate 10 to connect to a narrowed proximal end of the transparent electrode Xa.

Likewise, row electrode Y is composed of a transparent electrode Ya which is formed in a T-like shape of a transparent conductive film made of ITO or the like, and a bus electrode Yb which is formed of a metal film extending in the row direction of the front glass substrate 10 to connect to a narrowed proximal end of the transparent electrode Ya.

The row electrodes X and Y are alternated in the column direction (in the vertical direction in FIG. 1) of the front glass substrate 10. The transparent electrodes Xa and Ya arranged along the respective bus electrodes Xb and Yb, extend mutually toward a mate of the paired row electrodes such that the top sides (or the distal ends) of widened portions of the transparent electrodes Xa and Ya face each other with a discharge gap g having a predetermined width in between.

Each of the bus electrodes Xb and Yb is formed in a double-layer structure with a black conductive layer Xb' or Yb' on the display surface side and a main conductive layer Xb" or Yb" on the back surface side.

On the backside of the front glass substrate 10, quadrangular floating electrodes F1 are respectively formed in a middle position between the widened portions of the adjacent T-shaped transparent electrodes Xa in the row electrode X, and a middle position between the widened portions of the adjacent T-shaped transparent electrodes Ya in the row electrode Y.

The floating electrode F1 is formed of the same transparent conductive film made of ITO or the like as that of the transparent electrodes Xa, Ya of the row electrodes X, Y, or a metal film of the same materials as that of the bus electrodes Xb, Yb.

The floating electrode F1 is formed by means of the patterning or the like at the same time when the transparent electrodes Xa, Ya and the bus electrodes Xb, Yb of the row electrodes X, Y are formed.

On the backside of the front glass substrate 10, a dielectric layer 11 is further formed to overlay the row electrode pairs (X, Y) and the floating electrode F1. Furthermore, on the backside of the dielectric layer 11, an additional dielectric layer 11A is formed at each position which opposes to the adjacent bus electrodes Xb and Yb of the respective row electrode pairs (X, Y) adjacent to each other, plus which opposes to an area between the adjacent bus electrodes Xb and Yb. The first additional dielectric layer 11A is formed on the backside of the dielectric layer 11 to protrude therefrom and to extend in parallel to the bus electrodes Xb and Yb.

On the backsides of the dielectric layer 11 and the additional dielectric layers 11A, a protective layer 12 made of MgO is formed to cover them.

Next, a back glass substrate 13 is placed in parallel to the front glass substrate 10. On the front surface of the back glass substrate 13 facing toward the display surface, column electrodes D are disposed in parallel at regularly established intervals from one another to extend at positions, opposing the transparent electrodes Xa and Ya of the respective pairs of the row electrodes (X, Y), in a direction orthogonal to the row electrode pair (X, Y) (the column direction).

A white dielectric layer 14 is further formed on the face of the back glass substrate 13 on the display surface side to overlay the column electrodes D, and a partition wall 15 is formed on the dielectric layer 14.

The partition wall 15 is formed in a pattern, in which parallel lines cross at right angles, by a vertical wall 15*a* extending in the column direction between the adjacent column electrodes D arranged in parallel to each other, and a transverse wall 15*b* extending in the row direction at a position opposing each additional dielectric layer 11A.

The partition wall 15 defines the discharge space S between the front glass substrate 10 and the back glass substrate 13 into a chessboard-square-like pattern to form a quadrangular discharge cell C for each area opposing the paired transparent electrodes Xa and Ya of each row electrode pair (X, Y).

The partition wall 15 is formed in a double-layer structure with a black layer (a light absorption layer) 15' on the display surface side and a white layer (a light reflection layer) 15" on the back surface side, which is configured such that the side wall facing the discharge cell C is almost white (i.e. a light reflection layer).

The face of the transverse wall 15*b* on the display surface side is in contact via the protective layer 12 with the additional dielectric layer 11A. The additional dielectric layer 11A and the transverse wall 15*b* shield the adjacent discharge cells C in the column direction from each other.

The face of the vertical wall 15*a* of the partition wall 15 on the display surface side faces the backside of the dielectric layer 11 via the clearance r, and further faces a pair of floating electrodes F1 which are respectively formed in the middle position between the widened portions of the adjacent T-shaped transparent electrodes Xa in the row electrode X, and the middle position between the widened portions of the adjacent T-shaped transparent electrodes Ya in the row electrode Y.

On the five faces of a surface of the dielectric layer 14 and the side faces of the vertical walls 15*a* and the transverse walls 15*b* of the partition wall 15 facing each discharge cell C, the phosphor layer 16 is formed to overlay all of them.

The phosphor layers 16 are arranged in order of red (R), green (G) and blue (B) in the particular discharge cells in the row direction.

The discharge space of each of the discharge cells C is filled with a discharge gas.

In the above PDP, a row electrode pair (X, Y) make up a display line (row) L on a matrix display screen. The partition wall 15 of the parallel-crosses-like pattern defines the discharge space S in the chessboard-square-like pattern to form the quadrangular discharge cells C.

Operation of displaying an image on the PDP is carried out as in the case of the conventional PDP.

Specifically, first, through addressing operation, the discharge is produced selectively between the row electrode pairs (X, Y) and the column electrodes D in the respective discharge cells C, to scatter lighted cells (the discharge cell formed with wall charge on the dielectric layer 11) and nonlighted cells (the discharge cell not formed with wall charge on the dielectric layer 11), in all the display lines L over the panel in accordance with the image to be displayed.

After the addressing operation, in all the display lines L, the discharge sustain pulse is applied alternately to the row electrode pairs (X', Y') in unison. In each lighted cell, surface discharge is caused for every application of the discharge sustaining pulse.

In this manner, the surface discharge in each lighted cell generates ultraviolet radiation, and thus the red, green and/or blue phosphor layers 16 formed in the discharge space S are excited to emit light, resulting in forming an image to be displayed.

At this time, the caused surface discharge tends to spread into an adjacent discharge cell C in the column direction, but the spread is obstructed by the additional dielectric layer 11A and the transverse wall 15*b* of the partition wall 15 which shield the adjacent discharge cells C in the column direction from each other.

Further, when a surface discharge caused around the gap g formed between the widened portions of the transparent electrodes Xa and Ya, is scattering via the clearance r onto the transparent electrodes Xa and Ya in an adjacent discharge cell C in the row direction, the surface discharge is attracted by the floating electrodes F1 provided at positions facing the clearance r between the adjacent discharge cells C in the row direction.

Hence, the surface discharge cannot reach the transparent electrodes Xa and Ya in an adjacent discharge cell C. That is the moving of the surface discharge to an adjacent discharge cell C is blocked around the vertical wall 15*a* of the partition wall 15 situated between the two discharge cells C in the row direction.

As a result, the spread of the surface discharge in the row direction is suppressed and occurrence of interference of discharge is prevented between the adjacent discharge cells C.

The feeding and removing of a discharge gas into and from each discharge cell C is performed through the clearance r, formed between the vertical wall 15*a* and the dielectric layer 11.

Moreover, the priming effect of causing the discharge between the adjacent discharge cells C in the row direction such as in a chain reaction, or causing the discharge to transfer to the adjacent discharge cell in the row direction, is secured through the clearance r.

Figure 7:
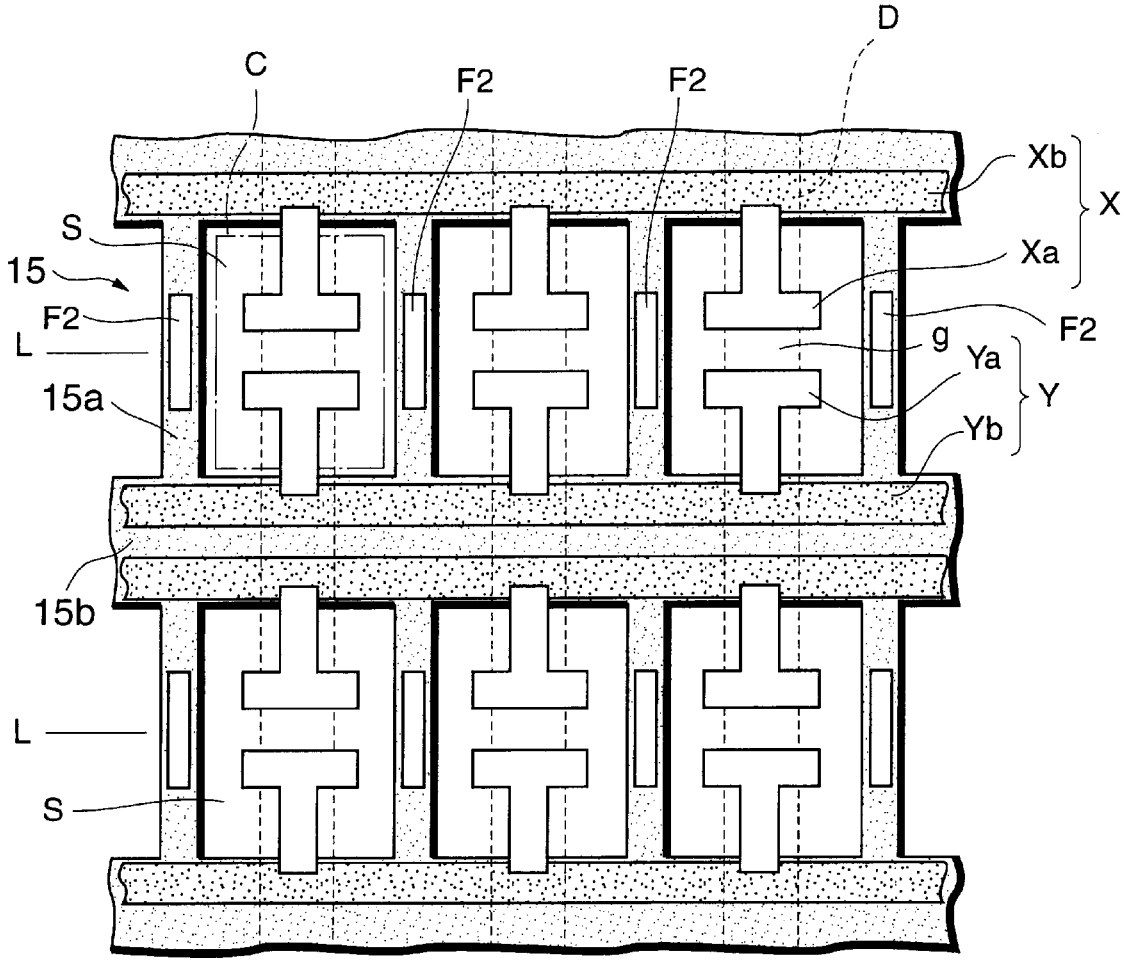
FIG. 7 is a schematically front view illustrating a second example of the embodiment according to the present invention.

FIG. 7 is a front view schematically showing a second example of the embodiment of the PDP according to the present invention.

In the above first example, a pair of floating electrodes F1 are formed between the widened portions of the two transparent electrodes Xa adjacent to each other and between the widened portions of the two transparent electrodes Ya adjacent to each other, that is to say the two floating electrodes F1 are formed to face one vertical wall 15*a*. However, in the PDP of the second example, one floating electrode F2 is formed to extend from a point between the widened portions of the two transparent electrodes Xa adjacent to each other to a point between the widened portions of the two transparent electrodes Ya adjacent to each other in a portion on the backside of the front glass substrate 10 (see FIG. 2) facing the vertical wall 15*a*.

Other parts of the configuration are the same as or similar to those in the first example, and the same numeral references are used.

In the PDP of the second example, when a surface discharge caused around the gap g formed between the widened portions of the transparent electrodes Xa and Ya, is scattering onto the transparent electrodes Xa and Ya in an adjacent discharge cell C in the row direction, the surface discharge is attracted by the floating electrode F2 provided at positions facing the clearance r between the adjacent discharge cells C in the row direction.

Hence, the moving of the surface discharge to an adjacent discharge cell C is blocked. This prevents interference of discharge from occurring between the adjacent discharge cells C in the row direction.

According to the PDP of the second example, the floating electrode F2 is provided not only between the widened portions of the two adjacent transparent electrodes Xa and between the widened portions of the two adjacent transparent electrodes Ya as in the first example, but also between the gaps g of the two row electrode pairs (X, Y) adjacent to each other. Therefore, the scattering of the surface discharge to the transparent electrodes Xa, Ya of an adjacent discharge cell C in the row direction is further effectively blocked, resulting in prevention of the interference between discharges.

Figure 8:
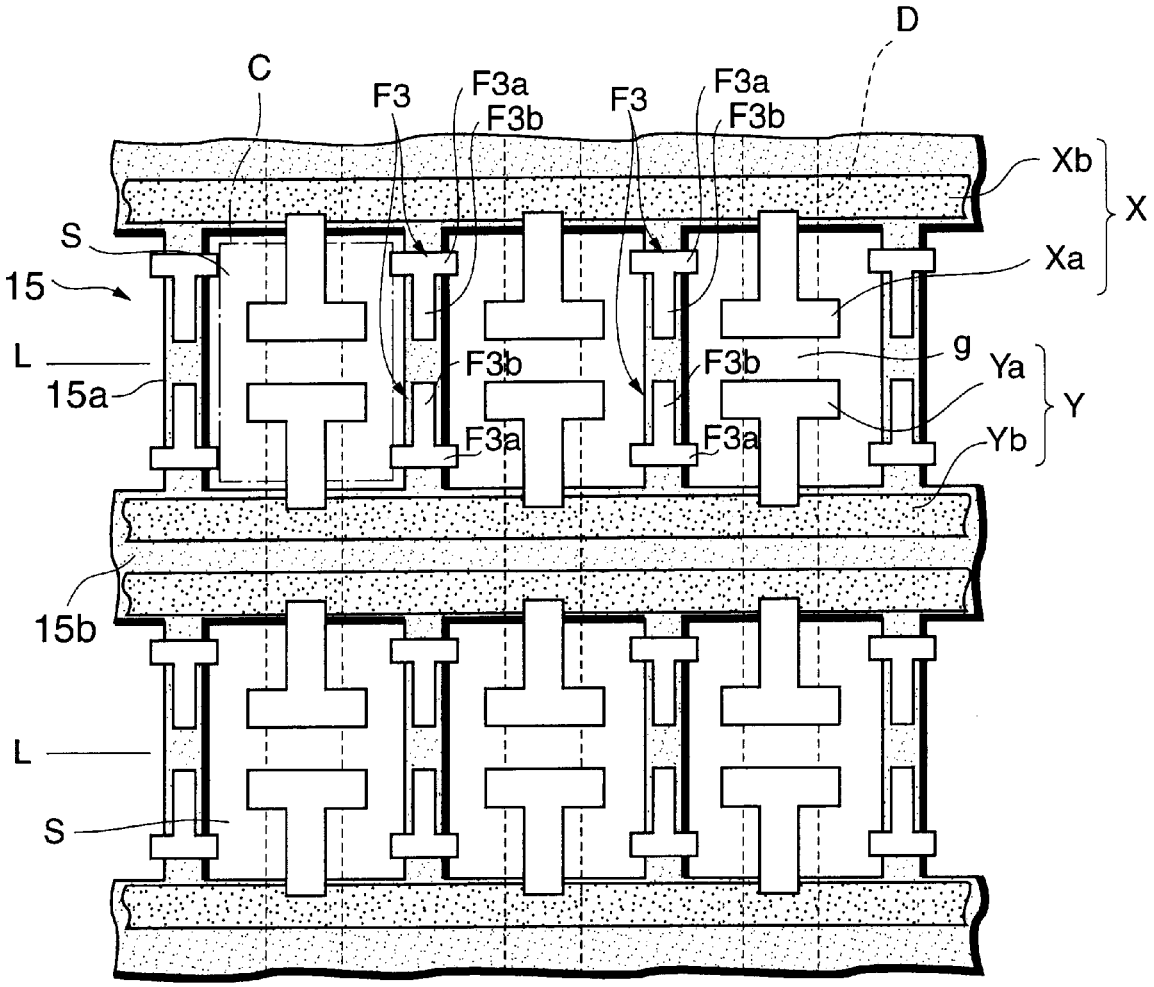
FIG. 8 is a schematically front view illustrating a third example of the embodiment according to the present invention.

FIG. 8 is a front view schematically showing a third example of the embodiment of the PDP according to the present invention.

As in the aforementioned PDP of the first example, in the PDP in the third example, a pair of floating electrodes F3 are formed between the widened portions of the two adjacent transparent electrodes Xa and between the widened portions of the two adjacent transparent electrodes Ya on the backside of the front glass substrate 10 (see FIG. 2), that is to say the two floating electrodes F3 are formed to face one vertical wall 15*a*.

The floating electrodes F3 respectively extend from between the two transparent electrodes Xa and between two transparent electrodes Ya toward the bus electrodes Xb and Yb. Each floating electrode F3 is formed in a T-like shape provided integrally with a widthwise extended portion F3*a*, extending in the direction perpendicular to the vertical wall 15*a*, at one end thereof.

In the PDP in the third example, a narrow main body F3*b* of the floating electrode F3 formed to face the vertical wall 15*a* of the partition wall 15 can be prevented from peeling by the widthwise extended portion F3*a* formed in a direction at right angles to the main body F3*b*.

Figure 9:
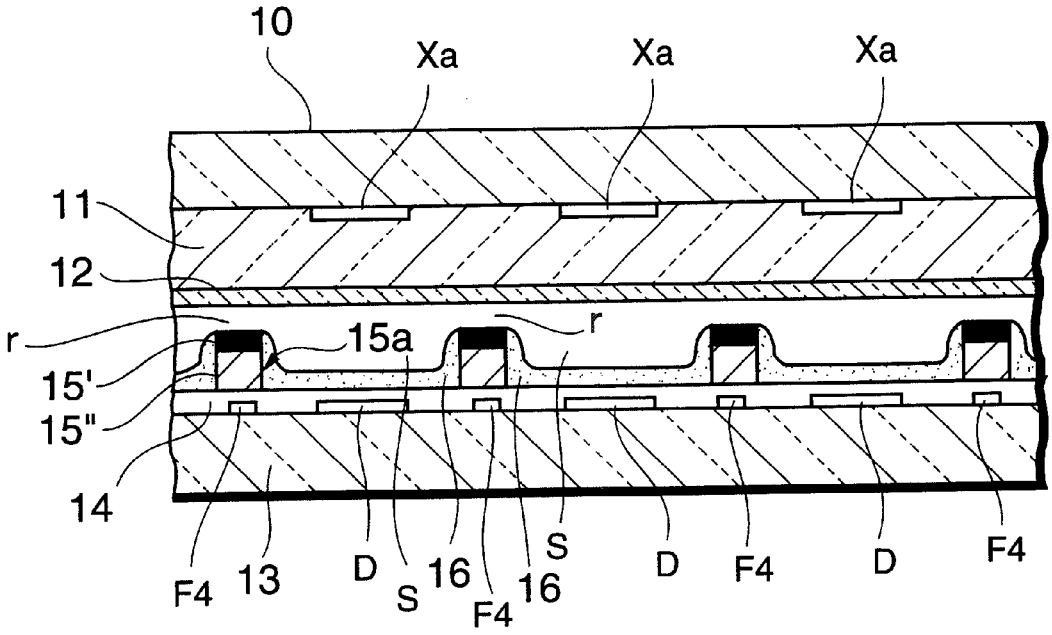
FIG. 9 is a schematically sectional view illustrating a fourth example of the embodiment according to the present invention.
Figure 10:
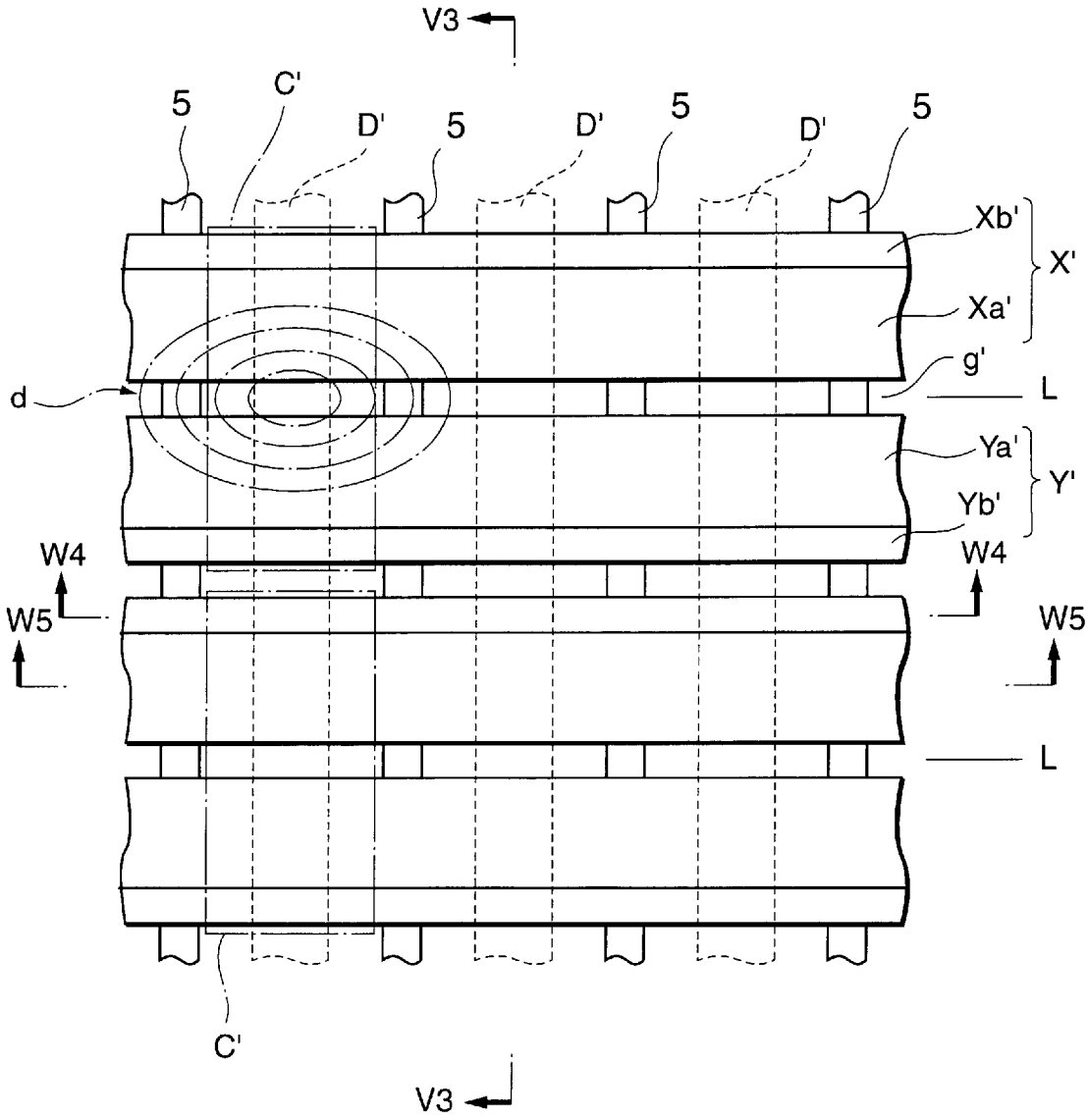
FIG.10 PRIOR ART
FIG. 10 is a schematically front view illustrating a conventional plasma display panel.
Figure 11:
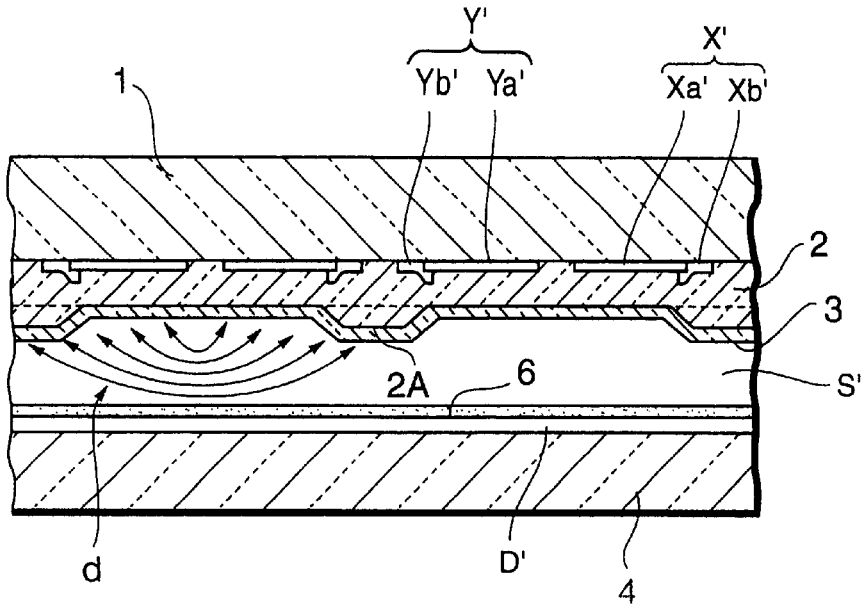
FIG.11 PRIOR ART
FIG. 11 is a sectional view taken along the V3—V3 line of FIG. 10.
Figure 12:
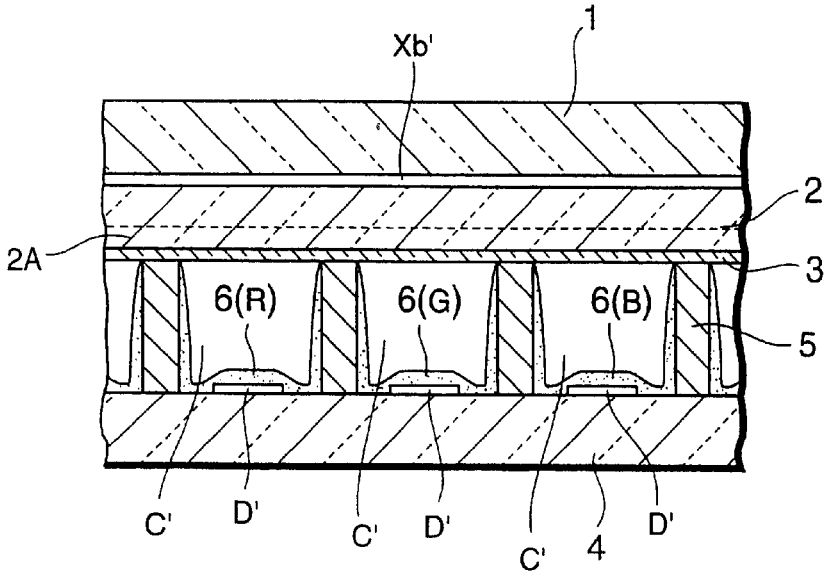
FIG.12 PRIOR ART
FIG. 12 is a sectional view taken along the W4—W4 line of FIG. 10.
Figure 13:
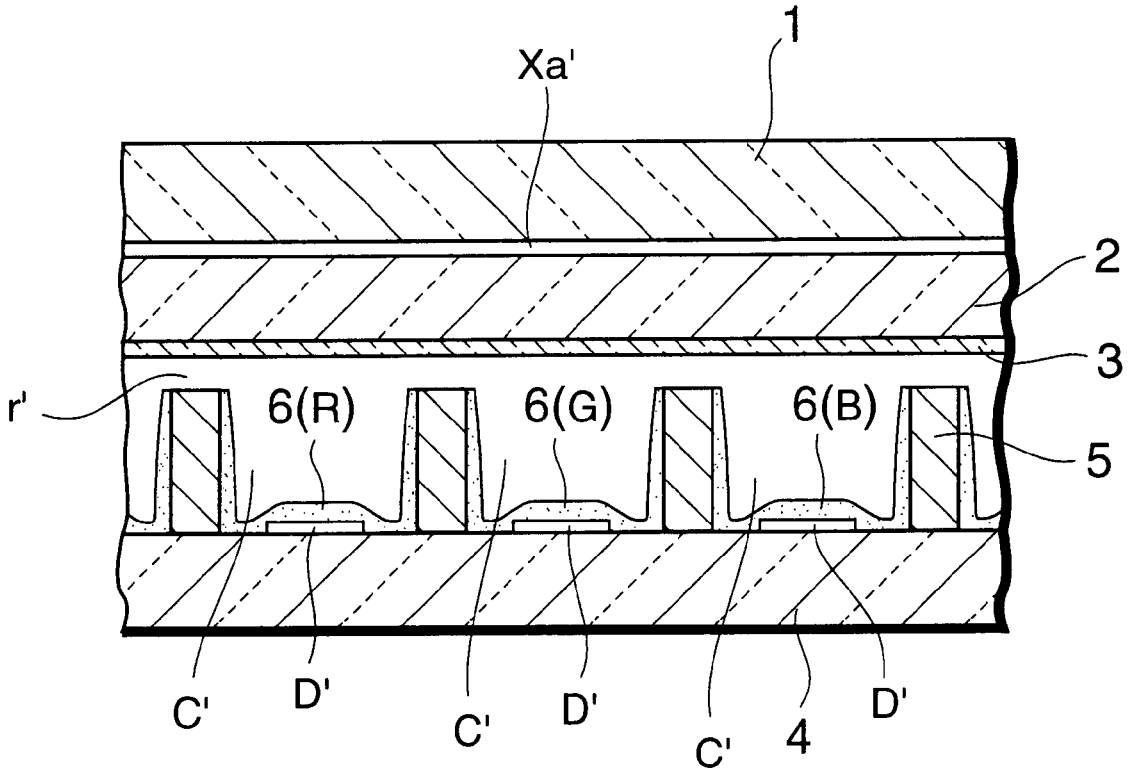
FIG.13 PRIOR ART
FIG. 13 is a sectional view taken along the W5—W5 line of FIG. 10.

FIG. 9 is a sectional view of the same part as that in FIG. 4, showing a fourth example of the embodiment of the PDP according to the present invention.

The floating electrode F1, F2, F3 are formed on the front glass substrate 10 side in the aforementioned PDP of the first to third examples, whereas in the PDP of the fourth example, a floating electrode F4 is formed a portion facing the vertical wall 15*a* in a middle portion of the two adjacent column electrodes D on the back glass substrate 13.

It is possible to select any shape in the first to third examples for a shape of the floating electrode F4.

As in the case of the first to third examples, in the PDP of the fourth example, the floating electrode F4 can prevent occurrence of interference between discharges in the adjacent discharge cells in the column direction in correspondence with the shape of the floating electrode F4.

Moreover, the fourth example can be applied to a PDP in which the transparent electrodes Xa and Ya are not formed independently in an island-like form for each discharge cell C as done in the first to third examples.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction on a back substrate facing the front substrate with a discharge space in between, and unit light emitting areas formed to be partitioned by a partition wall having a plurality of vertical walls extending in the column direction in a discharge space corresponding to each intersection of the column electrode and the row electrode pair, said plasma display panel comprising:

a floating electrode provided each portion on at least one of the front substrate and the back substrate facing a vertical wall of the plurality of vertical walls of the partition wall defining a partition between the unit light emitting areas adjacent to each other in the row direction.

2. The plasma display panel according to claim 1, wherein said floating electrode is formed of a transparent conductive film or a metal film.

3. The plasma display panel according to claim 1, wherein the floating electrode has a widthwise extended portion integrated with a main body extending along the vertical wall of the plurality of vertical walls of the partition wall facing the main body, and extending in a direction perpendicular to the vertical wall of the plurality of vertical walls of the partition wall.

4. A plasma display panel including a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction on a back substrate facing the front substrate with a discharge space in between, and unit light emitting areas formed to be partitioned by a partition wall having a plurality of vertical walls extending in the column direction in a discharge space corresponding to each intersection of the column electrode and the row electrode pair, said plasma display panel comprising:

a floating electrode provided each portion on at least one of the front substrate and the back substrate facing a vertical wall of the plurality of vertical walls of the partition wall defining a partition between the unit light emitting areas adjacent to each other in the row direction, wherein transparent electrodes of the row electrode pair opposing each other via a predetermined gap are formed in an independent island form in each unit light emitting area, and the floating electrode is provided at a position between distal ends of the transparent electrodes in the two unit light emitting areas adjacent to each other in the row direction or a position facing the position between the distal ends of the transparent electrodes in the two unit light emitting areas.

5. The plasma display panel according to claim 4, wherein said floating electrode is formed of a transparent conductive film or a metal film.

6. The plasma display panel according to claim 4, wherein the floating electrode extends from a position opposing a distal portion of one transparent electrode of a pair of transparent electrodes to a position opposing a distal portion of the other transparent electrode of the pair of transparent electrodes.

7. The plasma display panel according to claim 4, wherein the floating electrode has a widthwise extended portion integrated with a main body extending along the vertical wall of the plurality of vertical walls of the partition wall facing the main body, and extending in a direction perpendicular to the vertical wall of the plurality of vertical walls of the partition wall.

8. A plasma display panel including a plurality of row electrode pairs extending in a row direction and arranged in a column direction to respectively form display lines and a dielectric layer overlaying the row electrode pairs on a backside of a front substrate, and a plurality of column electrodes extending in the column direction and arranged in the row direction on a back substrate facing the front substrate with a discharge space in between, and unit light emitting areas formed to be partitioned by a partition wall having a plurality of vertical walls extending in the column direction in a discharge space corresponding to each intersection of the column electrode and the row electrode pair, said plasma display panel comprising:

a floating electrode provided each portion on at least one of the front substrate and the back substrate facing a vertical wall of the plurality of vertical walls of the partition wall defining a partition between the unit light emitting areas adjacent to each other in the row direction, wherein the floating electrode extends from a position opposing a distal portion of one transparent electrode of a pair of transparent electrodes to a position opposing a distal portion of the other transparent electrode of the pair of transparent electrodes.

9. The plasma display panel according to claim 8, wherein said floating electrode is formed of a transparent conductive film or a metal film.

10. The plasma display panel according to claim 8, wherein transparent electrodes of the row electrode pair opposing each other via a predetermined gap are formed in an independent island form in each unit light emitting area, and the floating electrode is provided at a position between distal ends of the transparent electrodes in the two unit light emitting areas adjacent to each other in the row direction or a position facing the position between the distal ends of the transparent electrodes in the two unit light emitting areas.

11. The plasma display panel according to claim 8, wherein the floating electrode has a widthwise extended portion integrated with a main body extending along the vertical wall of the plurality of vertical walls of the partition wall facing the main body, and extending in a direction perpendicular to the vertical wall of the plurality of vertical walls of the partition wall.

* * * * *